US007136044B2

(12) United States Patent
Sasaki

(10) Patent No.: US 7,136,044 B2
(45) Date of Patent: Nov. 14, 2006

(54) DISPLAY APPARATUS

(75) Inventor: Takashi Sasaki, Mie (JP)

(73) Assignee: Sharp Kabushiki Kaisha, Osaka (JP)

( * ) Notice: Subject to any disclaimer, the term of this patent is extended or adjusted under 35 U.S.C. 154(b) by 243 days.

(21) Appl. No.: 10/505,549

(22) PCT Filed: Dec. 26, 2002

(86) PCT No.: PCT/JP02/13730

§ 371 (c)(1),
(2), (4) Date: Aug. 23, 2004

(87) PCT Pub. No.: WO03/075257

PCT Pub. Date: Sep. 12, 2003

(65) Prior Publication Data

US 2005/0104838 A1 May 19, 2005

(30) Foreign Application Priority Data

Mar. 7, 2002 (JP) ..... 2002-062729

(51) Int. Cl.
*G09G 3/36* (2006.01)

(52) U.S. Cl. ..... 345/102; 349/61

(58) Field of Classification Search ..... 345/102; 349/61

See application file for complete search history.

(56) References Cited

U.S. PATENT DOCUMENTS

| | | | | |
|---|---|---|---|---|
| 5,717,422 | A | 2/1998 | Fergason | |
| 6,111,559 | A * | 8/2000 | Motomura et al. | 345/102 |
| 6,795,053 | B1 * | 9/2004 | Funamoto et al. | 345/102 |

FOREIGN PATENT DOCUMENTS

| | | |
|---|---|---|
| JP | 05-066501 | 3/1993 |
| JP | 06-102484 | 4/1994 |
| JP | 06-160811 | 6/1994 |
| JP | 09-244548 | 9/1997 |
| JP | 11-065528 | 3/1999 |
| JP | 11-109317 | 4/1999 |
| JP | 2002-156951 | 5/2002 |
| JP | 2002-258401 | 9/2002 |
| WO | WO 00/68926 | 11/2000 |

OTHER PUBLICATIONS

Nikkei Electronics No. 757 (published on Nov. 15, 1999).

* cited by examiner

*Primary Examiner*—Richard Hjerpe
*Assistant Examiner*—Michael Pervan
(74) *Attorney, Agent, or Firm*—Harness, Dickey & Pierce, P.L.C.

(57) ABSTRACT

The invention provides a display panel 9; a gain variable liquid crystal driving circuit 10 for driving the display panel 9; a backlight operating circuit 6 for operating, based on a lamp control signal, a backlight 8 for illuminating the display panel 9; a level extension signal calculating circuit 11 for outputting an optical output level extension signal Lout by extending a predetermined output level used to operate the backlight 8; and a white peak improving circuit 5 for receiving the optical output level extension signal, and for outputting a lamp control signal, whose white peak level has been adjusted according to a change in brightness of a scene and for calculating and outputting a video amplitude gain as a coefficient to a gain variable driving amplifier circuit 3, wherein the lamp control signal is outputted when the brightness of a scene is above normal level, and the video amplitude gain is outputted when the brightness is at normal level.

15 Claims, 13 Drawing Sheets

FIG.3 (a) OPTICAL OUTPUT GAIN Gs
1.0
0
FIG.3 (b) MULTIPLICATION RESULT Ls OF OPTICAL OUTPUT GAIN Gs AND L0
L0
0
FIG.3 (c) OPTICAL OUTPUT LEVEL EXTENSION SIGNAL Lout
LAMP PEAK
L0
0
FIG.3 (d) WAVEFORM RESTRICTION
L1(=L0)
0
FIG.3 (e) LEVEL CONVERSION
FIG.3 (f) DIFFERENTIATION
FIG.3 (g) LUMINANCE CONVERSION ADAPTATION
FIG.3 (h) UPPER LIMIT CLIP
(LAMP PEAK)−L1
0
FIG.3 (i) BACKLIGHT CONTROL SIGNAL
LAMP PEAK

OUTPUT OF LEVEL CONVERTING CIRCUIT

RESULT OF DIFFERENTIATING

FIG.7 (a) OUTPUT OF DIFFERENTIATING CIRCUIT
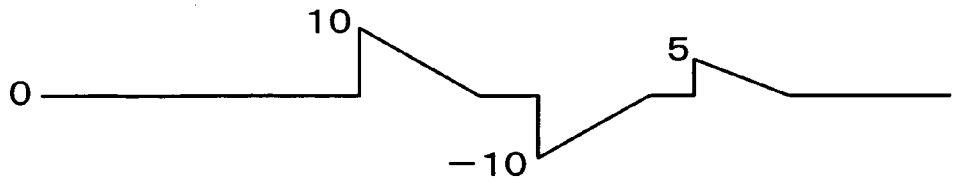
FIG.7 (b) POSITIVE COMPONENT Xdp
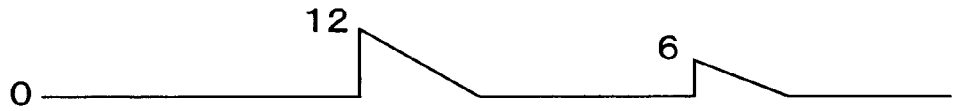
FIG.7 (c) NEGATIVE COMPONENT Xdm
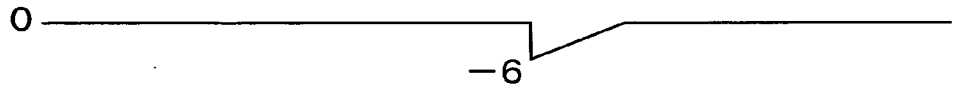
FIG.7 (d) OUTPUT OF LUMINANCE ADAPTIVE CONVERTING CIRCUIT
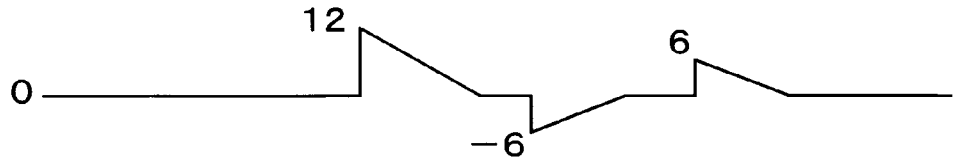

FIG.9 (a) OUTPUT OF LUMINANCE ADAPTIVE CONVERTING CIRCUIT
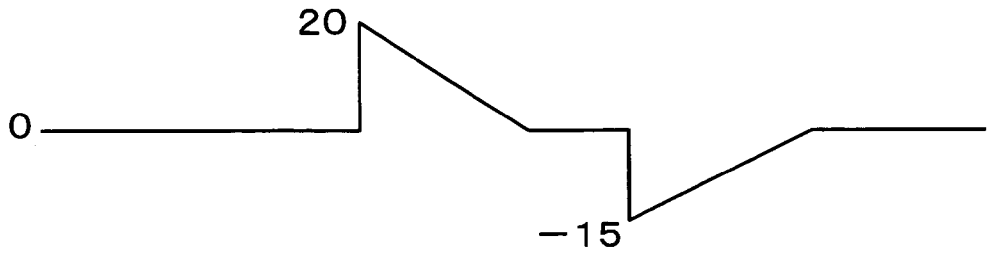
FIG.9 (b) OUTPUT OF CLIP CIRCUIT (WHEN THp = 10, THm = -10)
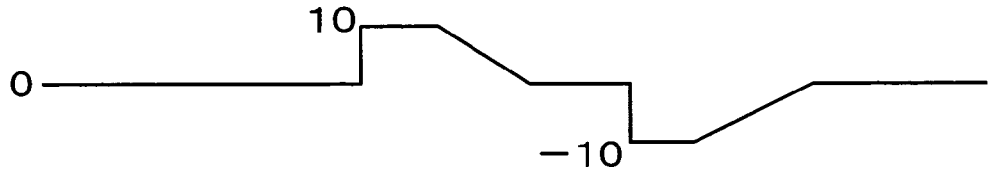

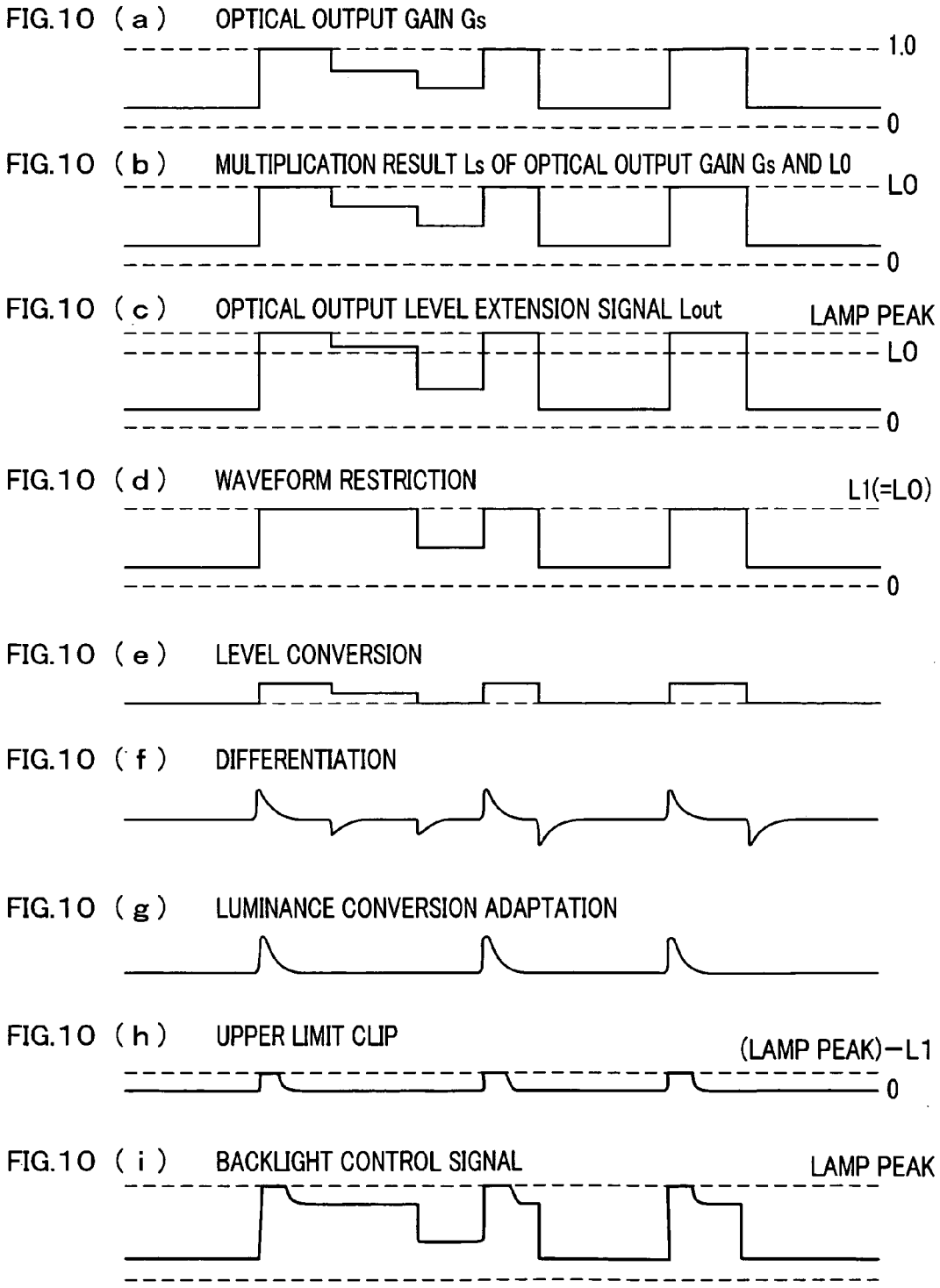
FIG.10 (a) OPTICAL OUTPUT GAIN Gs
1.0
0
FIG.10 (b) MULTIPLICATION RESULT Ls OF OPTICAL OUTPUT GAIN Gs AND L0
L0
0
FIG.10 (c) OPTICAL OUTPUT LEVEL EXTENSION SIGNAL Lout
LAMP PEAK
L0
0
FIG.10 (d) WAVEFORM RESTRICTION
L1(=L0)
0
FIG.10 (e) LEVEL CONVERSION
FIG.10 (f) DIFFERENTIATION
FIG.10 (g) LUMINANCE CONVERSION ADAPTATION
FIG.10 (h) UPPER LIMIT CLIP
(LAMP PEAK)−L1
0
FIG.10 (i) BACKLIGHT CONTROL SIGNAL
LAMP PEAK FIG.12 (a) OPTICAL OUTPUT CONTROL SIGNAL
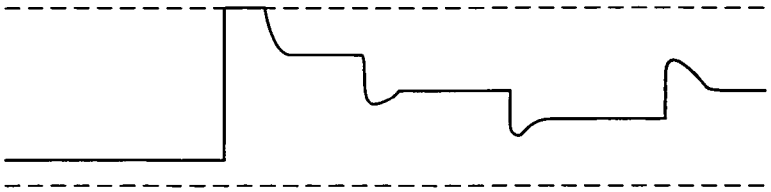
FIG.12 (b) VIDEO AMPLITUDE GAIN
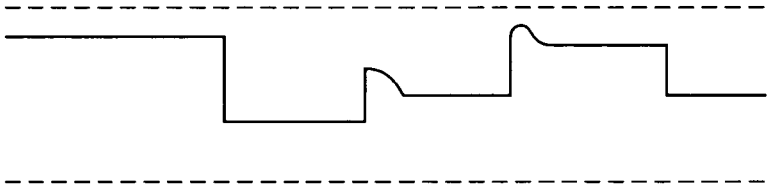
FIG.12 (c) PEAK LEVEL OF INPUT VIDEO
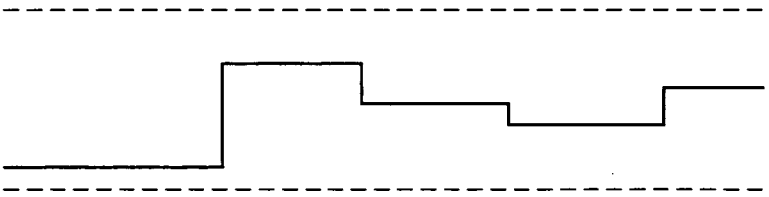
FIG.12 (d) PEAK LEVEL OF OUTPUT VIDEO
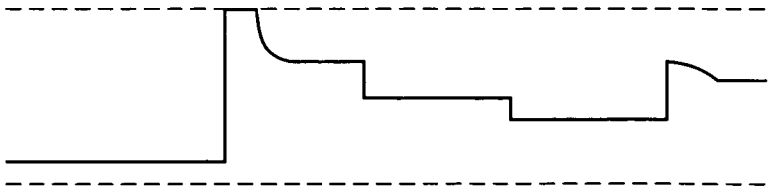

DISPLAY APPARATUS

TECHNICAL FIELD

The present invention concerns improvement in display quality of a display panel such as a liquid crystal panel, and particularly relates to a display apparatus for improving both contrast in a dark scene and white peak luminance.

BACKGROUND ART

In recent years, various types of liquid crystal color displays have been developed and marketed. One of the important goals in achieving better display quality in liquid crystal displays is to improve white peak in a bright scene and contrast in a dark scene.

In one conventional method of improving contrast in a dark scene, a gain is calculated from the peak level of a video signal during predetermined intervals of time, and the output level of light is reduced and the amplitude of the video signal is extended according to the calculated gain, as disclosed in Japanese Unexamined Patent Application Nos. 102484/1994 (Tokukaihei 6-102484; published on Apr. 15, 1994), 109317/1999 (Tokukaihei 11-109317; published on Apr. 23, 1999), and 65528/1999 (Tokukaihei 11-65528; published on Mar. 9, 1999), for example. With this method, contrast can be improved in a bark scene without varying display brightness.

FIG. 13 illustrates a conventional liquid crystal display device with improved contrast in a dark scene.

The liquid crystal display device includes, for example, a peak level detecting circuit 201, a gain calculating circuit 202, an amplitude modulating circuit 203, an optical output control circuit 204, a backlight operating circuit 205, a liquid crystal driving circuit 206, a backlight 207, and a liquid crystal panel 208.

The peak level detecting circuit 201 receives a video signal and outputs a peak level. The gain calculating circuit 202 receives the output peak level from the peak level detecting circuit 201 and outputs a gain.

The output gain of the gain calculating circuit 202 is supplied to the amplitude modulating circuit 203 and the optical output control circuit 204. The amplitude modulating circuit 203, having received the output gain and a video signal, outputs an amplitude-modulated video signal, so as to drive the liquid crystal panel 208 through the liquid crystal driving circuit 206. The optical output control circuit 204, having received the output gain of the gain calculating circuit 202, outputs a backlight control signal for controlling the brightness of the backlight 207, so as to operate the backlight 207 through the backlight operating circuit 205.

Described below is one exemplary operation of the liquid crystal display device improving contrast in a dark scene.

First, in response to an input video signal, the peak level detecting circuit 201 detects a peak level during certain intervals of time, for example, such as a vertical synchronous period, and outputs the detected peak level to the gain calculating circuit 202. In response, the gain calculating circuit 202 calculates a gain value.

For example, the gain value is 0.5 when the peak value of the video is half the 100IRE value (i.e., 50IRE), and is 1.0 when the peak value of the video is 100IRE. The gain value calculated in the gain calculating circuit 202 is supplied to the amplitude modulating circuit 203 and the optical output control circuit 204. In the amplitude modulating circuit 203, the amplitude of the video signal is divided by the gain value. In the optical output control circuit 204, a normal control signal for operating the backlight 207 is multiplied by the gain value to obtain a new control signal for the backlight 207. Note that, "100IRE" is an input signal when the video is white. Accordingly, when the peak value of the video is 100IRE, it means that the peak value of the input video signal during certain intervals of time is the highest gradation level of white.

With this method, when the peak of the video signal is 50IRE for example, the amplitude of the video signal is doubled and the brightness of the backlight 207 is reduced in half. The end result of this is that the number of gradations in the video signal is doubled and contrast is improved in a dark scene, without varying display brightness.

That is, the method does not change the overall display brightness because the multiplication of the control signal of the backlight 207 by the gain value is offset by the division of the video signal by the gain value.

A magazine article "Improve Image Quality of Liquid Crystal Panel by Controlling Luminance of Light Source" (Nikkei Electronics, Nov. 15, 1999, No. 757, pp. 139–146) suggests that improved white peak luminance can be achieved by increasing the overall image brightness. The article suggests that this can be accomplished by extending the control signal for the backlight in such a manner that the output luminance of the backlight is maximized not to the level of normal operating conditions but to the level allowed by the rating of the backlight. However, a problem of this conventional method whereby white peak luminance is improved, for example, by uniformly extending the control signal for the backlight is that the output video appears brighter than the input video in a dark scene, as compared with setting the maximum luminance at normal level.

For example, when the control signal for the backlight is extended 1.2 times, the maximum luminance becomes 1.2 times greater than its normal level, thereby improving white peak luminance. However, in this case, the minimum luminance is also increased 1.2 times, causing the phenomenon of pale black display. That is, a dark scene appears bright.

Further, in this case, since the improved peak luminance is accompanied by a proportional increase in minimum luminance, the dynamic range remains unchanged from the level set by a normal luminance.

It should be noted here that a wider dynamic range can be obtained when a dark scene is displayed at a minimum luminance without the extended gain value, and when a bright scene is displayed with a peak luminance with the extended gain value.

Another drawback of the foregoing method is that the extension of the gain value that multiplies the control signal for the backlight increases the inflow of a current into the backlight, with the result that power consumption is increased. Further, improvement of white peak luminance requires a process by which display brightness is increased from its normal level.

Turning back to the prior art shown in FIG. 13, display brightness does not change, and there accordingly will be no deterioration of display quality even when contrast is improved by, for example, doubling the amplitude of a video signal and reducing the brightness of the backlight in half. This contrasts to the foregoing magazine article, which, in order to improve peak luminance, requires the output video to be brighter than the input video. That is, the improvement of peak luminance is accompanied by a change in display brightness from its original level, which may lead to deterioration of the input video in terms of display quality.

The present invention was made in view of the foregoing problems, and it is an object of the present invention to provide a display apparatus that improves peak luminance in a bright scene and suppresses pale black display in a dark scene and thereby provide a wide dynamic range without increasing power consumption.

DISCLOSURE OF INVENTION

In order to achieve the foregoing object, a display apparatus of the present invention includes: a display panel; coefficient variable driving means for driving the display panel with an amplified video signal that is obtained by multiplying an input video signal by a variable coefficient; operating means for operating, based on a lamp control signal, a lamp for illuminating the display panel; level extension signal calculating means for outputting an optical output level extension signal by extending a predetermined output level used to operate the lamp, wherein the predetermined output level is extended based on an optical output gain obtained from the input video signal, and an output peak value of the lamp; and white peak improving means for receiving the optical output level extension signal, and for outputting a lamp control signal, whose white peak level has been adjusted according to a change in brightness of a scene, to the operating means, and for calculating and outputting a video amplitude gain, which adjusts an amplitude of a video signal, as a coefficient to the gain variable driving means, wherein the lamp control signal is outputted when the brightness of a scene is above normal level, and the video amplitude gain is outputted when the brightness is at normal level.

In the display apparatus of the present invention, the coefficient variable driving means includes: gain variable amplifying means for amplifying a video amplitude by obtaining a product of the video coefficient gain, which is a coefficient calculated by the white peak improving means, and the input video signal, and outputting the amplified video amplitude to driving means; and driving means for driving the display panel according to the amplified video amplitude.

Further, in the display apparatus of the present invention, the level extension signal calculating means includes: peak level detecting means for detecting a peak level of the input video signal during certain intervals of time; optical output gain calculating means for producing an optical output gain by calculation from the peak level detected by the peak level detecting means; and optical output control means for outputting the optical output level extension signal such that a maximum value of products obtained by multiplying the optical output gain of the optical output gain calculating means by a predetermined optical output level for operating the lamp coincides with a peak value of the lamp.

The display apparatus of the present invention is a modification over a conventional display apparatus, wherein the white peak improving means is additionally provided, and an amplitude modulating circuit, which is provided as modulating means, is replaced with the gain variable amplifying means.

The white peak improving means receives an optical output level extension signal from the optical output control means of the level extension signal calculating circuit, modulates the optical output level extension signal to improve white peak luminance, and outputs a lamp control signal to the operating means. The white peak improving means also calculates a video amplitude gain, which is a coefficient for amplifying a video amplitude, and outputs it to the gain variable amplifying means of the coefficient variable driving means. In response, the gain variable amplifying means amplifies the video signal based on the video amplitude gain, and outputs it to the driving means.

In this manner, when the brightness of the input video is of a scene brighter than normal brightness, a change in brightness of the scene is detected from a time-dependent change in peak level of the video signal, and the output light of the lamp is spontaneously controlled according to the change in brightness of the scene. In this way, white peak brightness can be improved as perceived by a viewer.

It is therefore possible, by the provision of the white peak improving means in a conventional contrast improving circuit, to provide a display apparatus that improves peak luminance in a bright scene and suppresses pale black display in a dark scene without increasing power consumption.

In the display apparatus of the present invention, the white peak improving means includes: a varied component detecting block for detecting a varied component of brightness, and calculating a correction signal for the lamp control signal so as to facilitate a change in brightness; a reference signal/video amplitude gain calculating block for calculating a reference signal for the lamp control signal, and the video amplitude gain; and adding means for adding the output of the varied component detecting block and the reference signal for the lamp control signal, and outputting a result of calculation as the lamp control signal.

According to the invention, the white peak improving means includes a varied component detecting block, a reference signal/video amplitude gain calculating block, and adding means for adding the output of the varied component detecting block to the reference signal for the lamp control signal, and outputting the result of calculation as the lamp control signal. The varied component detecting block detects a varied component of brightness, and calculates a correction signal for the lamp control signal so as to facilitate the change in brightness. The reference signal/video amplitude gain calculating block calculates a reference signal for the lamp control signal, and the video amplitude gain.

Thus, with the input of a bright scene, the brightness of the lamp is spontaneously increased when the peak level is varied by a large amount, and is spontaneously reduced when the peak level is varied by a small amount. In this way, a change in brightness is facilitated and as a result white peak luminance is improved as perceived by a viewer. Further, because the lamp is controlled differently depending on whether the input video is of a bright scene or of normal brightness, there is no spontaneous change in the brightness of the lamp even when the brightness of the scene is changed at low level. The stability of black display is thus maintained in a dark scene, thus suppressing pale black display.

Further, in the display apparatus of the present invention, the varied component detecting block includes: a level converting circuit for subtracting a predetermined threshold from the optical output level extension signal outputted from the optical output control means, so as to output a positive component of a subtraction result; a differentiating circuit for differentiating an output signal of the level converting circuit with a certain time constant; a luminance adaptive converting circuit for multiplying the output of the differentiating circuit by a predetermined coefficient which is set for each of a positive component and a negative component of the output of the differentiating circuit, so as to calculate a signal for controlling a light quantity of the operating means; and a clip circuit for clipping an upper limit of the output of the luminance adaptive converting circuit, so as to prevent the lamp control signal from being outputted above the peak of the lamp.

According to the invention, the varied component detecting block includes a level converting circuit, a differentiating circuit, a luminance adaptive converting circuit, and a clip circuit. When the input video signal is of a relatively bright scene, the varied component detecting block detects a component of the peak level that has been changed with time, and calculates a correction signal for the lamp control signal so as to facilitate a change in brightness of the input video rendering a relatively bright scene.

That is, the level converting circuit subtracts a threshold from the optical output level extension signal supplied from the optical output control means, and extracts only the positive component from the result of subtraction, thereby extracting a waveform of the optical output level extension signal in the video of a relatively bright scene.

Thus, the white peak improving means determines whether the input video is of a relatively bright scene or of normal brightness, and facilitates a change in brightness of the peak level when the input video is a bright scene.

The differentiating circuit differentiates the output of the level converting circuit with a certain time constant, and detects a varied component of the optical output level extension signal in a relatively bright scene. Further, by setting a suitable time constant, the differentiating circuit controls the time-dependent change in brightness of the lamp so that the change appears natural to a viewer. This enables the white peak improving means to extract a varied component of the peak level when the input video is of a bright scene. Further, by setting a suitable time constant, a time-dependent change in brightness of the lamp can be made natural to a viewer.

The luminance adaptive converting circuit multiples a varied component of the output peak level of the differentiating circuit by a time constant, so that the amount of change in the lamp appears natural to a viewer. Further, the luminance adaptive converting circuit independently sets a coefficient for the positive and negative components of a varied component so that the positive and negative components are independently multiplied by their respective coefficients. In this way, a change in brightness in a dark-to-bright transition and a change in brightness in a bright-to-dark transition are independently controlled such that the change appears naturally to a viewer in both transitions. For example, the coefficient that multiplies the negative component may be set to 0 when a change in brightness in a bright-to-dark transition needs not to be facilitated.

The clip circuit is provided to clip the upper limit and lower limit of the control signal for the lamp, so that a current that flows into the lamp does not exceed the rated value when the control signal for the lamp is corrected.

By the provision of the foregoing circuits, the varied component detecting block calculates a correction signal for the lamp control signal, so as to facilitate a change in display brightness.

Thus, the varied component detecting block, with its constituent circuits, calculates a correction signal for the lamp control signal to ensure that a change in brightness is facilitated when the input video is of a relatively bright scene.

In the display apparatus of the present invention, the reference signal/video amplitude gain calculating block includes: a waveform restricting circuit for clipping, at a predetermined threshold, the optical output level extension signal outputted from the optical output control means, so as to output the clipped optical output level extension signal as the reference signal for the lamp control signal; and a video amplitude gain calculating circuit for calculating the video amplitude gain by normalizing and taking an inverse of the output signal of the waveform restricting circuit.

Further, in the display apparatus of the present invention, the waveform restricting circuit clips the optical output level extension signal by the threshold used by the level converting circuit.

According to the invention, the reference signal/video amplitude gain calculating block includes a waveform restricting circuit and a video amplitude gain calculating circuit, and calculates a reference signal for the lamp control signal, and the video amplitude gain.

That is, signals are produced that control the lamp and the video signal, enabling the lamp and the video amplitude to be controlled without causing unnaturalness in the brightness of the output video.

Specifically, the waveform restricting circuit uses the threshold to clip the optical output level extension signal supplied from the optical output control circuit, and calculates the reference signal for the lamp control signal. Preferably, the threshold is one used in the level converting circuit of the varied component detecting block. In this way, the white peak improving means determines whether the input video is of a relatively bright scene or of a scene of normal brightness, and carries out the control of not facilitating the change in brightness when the input video is of normal brightness, thereby suppressing pale black display in a dark scene.

Note that, the reference signal for the lamp control signal is a lamp control signal from which a component for facilitating a change in display brightness has been removed.

The video amplitude gain calculating circuit is a circuit for calculating a coefficient that amplifies the video signal according to the reference signal for the lamp control signal. By calculating a coefficient for adjusting the amplitude of the video signal, the video amplitude can be controlled without causing unnaturalness in the brightness of the output video.

In the adding means, the correction signal for the lamp control signal, calculated by the varied component detecting block, is added to the reference signal for the lamp control signal. Then, the adding means outputs a lamp control signal to enable the operating means to control the lamp in such a manner as to improve the peak level by facilitating a change in display brightness. The video amplitude gain is supplied to the gain variable amplifying means, and is multiplied by a video signal to amplify the video signal. The resulting video signal is supplied to the driving means.

The method adjusts a control signal for the lamp according to a change in display brightness in a bright scene. In a dark scene, a conventional control signal is used to improve black contrast. In this way, white peak can be improved in a bright scene without causing pale black display in a dark scene.

Further, the method can provide a wider dynamic range than the conventional method, because the minimum luminance that can be displayed in the display apparatus is equal to the minimum luminance of the conventional method when the white peak luminance is not improved, and because the maximum luminance that can be displayed in the display apparatus is equal to the maximum luminance of the conventional method when the white peak luminance is improved.

In improving white peak luminance, the conventional method turns on the lamp above a normal brightness so that the peak luminance is improved throughout a bright scene. In contrast, in the present embodiment, the brightness of the lamp is merely increased spontaneously when the peak level of the video signal increases, thereby reducing power consumption than conventionally in improving white peak.

In the display apparatus of the present invention, the varied component detecting block includes: a level converting circuit for subtracting a predetermined threshold from the optical output level extension signal outputted from the optical output control means, so as to output a positive component of a subtraction result; a differentiating circuit for differentiating an output signal of the level converting circuit with a certain time constant; a luminance adaptive converting circuit for multiplying a positive component of the output of the differentiating circuit by a predetermined coefficient and clipping a negative component, so as to calculate a signal for controlling a light quantity of the operating means; and a clip circuit for clipping an upper limit of the output of the luminance adaptive converting circuit, so as to prevent the lamp control signal from being outputted above the peak of the lamp.

According to the invention, the varied component detecting block of the white peak improving means adjusts the amplitude of a varied component of the peak level to facilitate a change in brightness and cause a spontaneous change in brightness of the lamp. When the peak level is changed from dark to bright, the varied component detecting block adjusts the amplitude so that the brightness change does not appear unnatural. On the other hand, when the peak level is changed from bright to dark, the varied component detecting block spontaneously amplifies the video amplitude by an amount that compensates for the spontaneous decrease in brightness of the lamp. With this control, a change in brightness does not cause a spontaneous reduction in display brightness.

Thus, with the white peak improving means that carries out level conversion independently for the respective amplitudes of the positive and negative components of the varied component of the output peak level of the differentiating circuit, the process of spontaneously varying the brightness of the lamp by facilitating a change in brightness can be carried out without causing unnaturalness in display brightness.

In the display apparatus of the present invention, the reference signal/video amplitude gain calculating block includes: a waveform restricting circuit for clipping, with a predetermined threshold, the optical output level extension signal outputted from the optical output control means, so as to output the clipped optical output level extension signal as the reference signal for the lamp control signal; and a video amplitude gain calculating circuit for calculating the video amplitude gain by normalizing and taking an inverse of a result of addition to a negative component of the output of the luminance adaptive converting circuit.

According to the invention, a coefficient for suitably adjusting the amplitude of a video signal is calculated according to the result of addition of the control signal of the lamp and the negative component of the output of the luminance adaptive converting circuit. In this way, the video amplitude can be adjusted and controlled without causing unnaturalness in the output display brightness. Further, with the coefficient, the video amplitude may be controlled so as not to facilitate a change in brightness when the peak level has changed from bright to dark.

Further, in the display apparatus of the present invention, the brightness is a parameter that is calculated from pixel information of a video and that indicates brightness of a video frame, irrespective of a signal type (YPbPr, YUV, RGB, etc.).

It is therefore preferable that the brightness is based on, for example, a parameter indicative of brightness, such as a maximum value, mean value, or minimum value of yellow (Y) in a video frame.

It is also preferable that the brightness is based on a combination of RGB values, which are parameters indicative of brightness, and that the brightness of the brightest pixel in a video frame is used as the brightness of the video frame.

Further, it is preferable that the brightness is an upper predetermined percent (e.g., upper 10 percent) of pixel brightness obtained from a histogram of parameters that indicate the brightness of a video frame.

Further, it is preferable that the brightness is determined not from information of a single video frame, but by taking into account information of a previous video frame.

It is also preferable that a scene of normal brightness and a scene brighter than normal brightness be separated from each other by a threshold.

Additional objects, features, and strengths of the present invention will be made clear by the description below. Further, the advantages of the present invention will be evident from the following explanation in reference to the drawings.

BRIEF DESCRIPTION OF DRAWINGS

FIG. 7(*a*) is a waveform diagram representing an output of the differentiating circuit provided in the white peak improving circuit, FIG. 7(*b*) is a waveform diagram representing a positive component output, FIG. 7(*c*) is a waveform diagram representing a negative component output, and FIG. 7(*d*) is a waveform diagram representing an output of the luminance adaptive converting circuit.

FIG. 9(*a*) is a waveform diagram representing an output of the luminance adaptive converting circuit provided in the white peak improving circuit, and FIG. 9(*b*) is a waveform diagram representing an output of the clip circuit provided in the white peak improving circuit.

FIG. 10(*a*) through FIG. 10(*i*) are waveform diagrams showing changes in a waveform of an optical output control signal in an optical output control circuit and a white peak improving circuit in another embodiment of the liquid crystal display device of the present invention.

FIG. 12(*a*) is a waveform diagram representing an optical output control signal, FIG. 12(*b*) is a waveform diagram representing an output indicative of a video amplitude gain, FIG. 12(*c*) is a waveform diagram representing a peak level of an input video signal, and FIG. 12(*d*) is a waveform diagram representing a peak level of an output video signal.

BEST MODE FOR CARRYING OUT THE INVENTION

In the following, the present invention will be described in detail by way of embodiments and comparative examples. It should be appreciated that the present invention is not limited in any ways by the following descriptions.

[First Embodiment]

One embodiment of the present invention is described below referring to FIG. 1 through FIG. 10. It should be noted that the present embodiment describes a liquid crystal display device as one form of a display apparatus. The liquid crystal display device may be a liquid crystal display panel, or other types of displays such as a projection-type liquid crystal projector.

Figure 1:
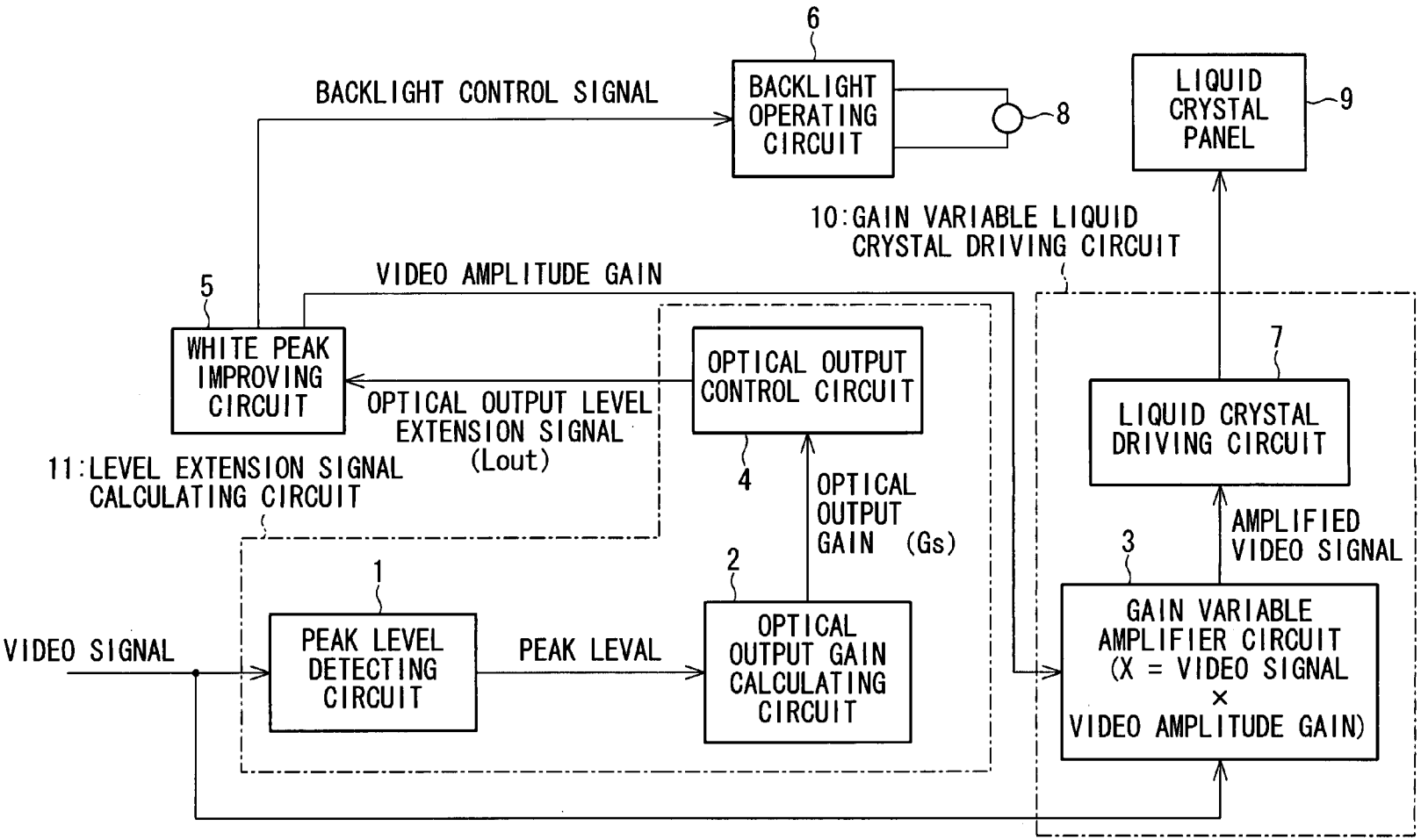
FIG. 1 is a block diagram illustrating one embodiment of a liquid crystal display device of the present invention.

As illustrated in FIG. 1, the liquid crystal display device of the present embodiment includes: a liquid crystal panel 9 provided as a display panel; a gain variable liquid crystal driving circuit 10 provided as coefficient variable driving means; a backlight operating circuit 6 provided as operating means for operating a backlight 8 (provided as a lamp for illuminating the liquid crystal panel 9) based on a backlight control signal (lamp control circuit); a level extension signal calculating circuit 11 provided as extension signal calculating means; and a white peak improving circuit 5 provided as white peak improving means.

The gain variable liquid crystal driving circuit 10 includes a gain variable amplifier circuit 3 and a liquid crystal driving circuit 7. The level extension signal calculating circuit 11 includes a peak level detecting circuit 1, an optical output gain calculating circuit 2, and an optical output control circuit 4.

In the liquid crystal display device, the peak level detecting circuit 1 detects and outputs a peak level of an input video signal during certain intervals of time. The optical output gain calculating circuit 2 receives the output peak level of the peak level detecting circuit 1, and calculates a gain value for controlling the output light of the backlight, so as to supply an optical output gain value Gs to the optical output control circuit 4. In response to the optical output gain value Gs from the optical output gain calculating circuit 2, the optical output control circuit 4 calculates a control signal for the backlight 8 according to the optical output gain value Gs, and supplies the resulting optical output control signal to the white peak improving circuit 5.

According to a change in the input backlight control signal, the white peak improving circuit 5 adjusts the backlight control signal to improve white peak luminance. Here, the white peak improving circuit 5 also calculates a video amplitude gain value for adjusting an amplitude of the video signal. The backlight control signal is supplied as a lamp control signal to the backlight operating circuit 6, and the video amplitude gain value is supplied to the gain variable amplifier circuit 3.

Based on the backlight control signal, the backlight operating circuit 6 adjusts the output light of the backlight 8. The gain variable amplifier circuit 3 multiplies the input video signal by the video amplitude gain to modulate the video amplitude, and supplies the modulated video signal to the liquid crystal driving circuit 7. In response to the input amplitude-modulated video signal, the liquid crystal driving circuit 7 operates the liquid crystal panel 9. The operation of the peak level detecting circuit 1 for detecting a peak level is a known technique, and accordingly detailed explanations thereof are omitted here. Further, no detailed explanation will be given for the operation of the optical output gain calculating circuit 2 because the calculation method of a gain is known from a conventional technique, even though the gain, which is supplied to the optical output control circuit and the amplitude modulation circuit in the conventional technique, is supplied only to the optical output control circuit in the present invention.

Figure 2:
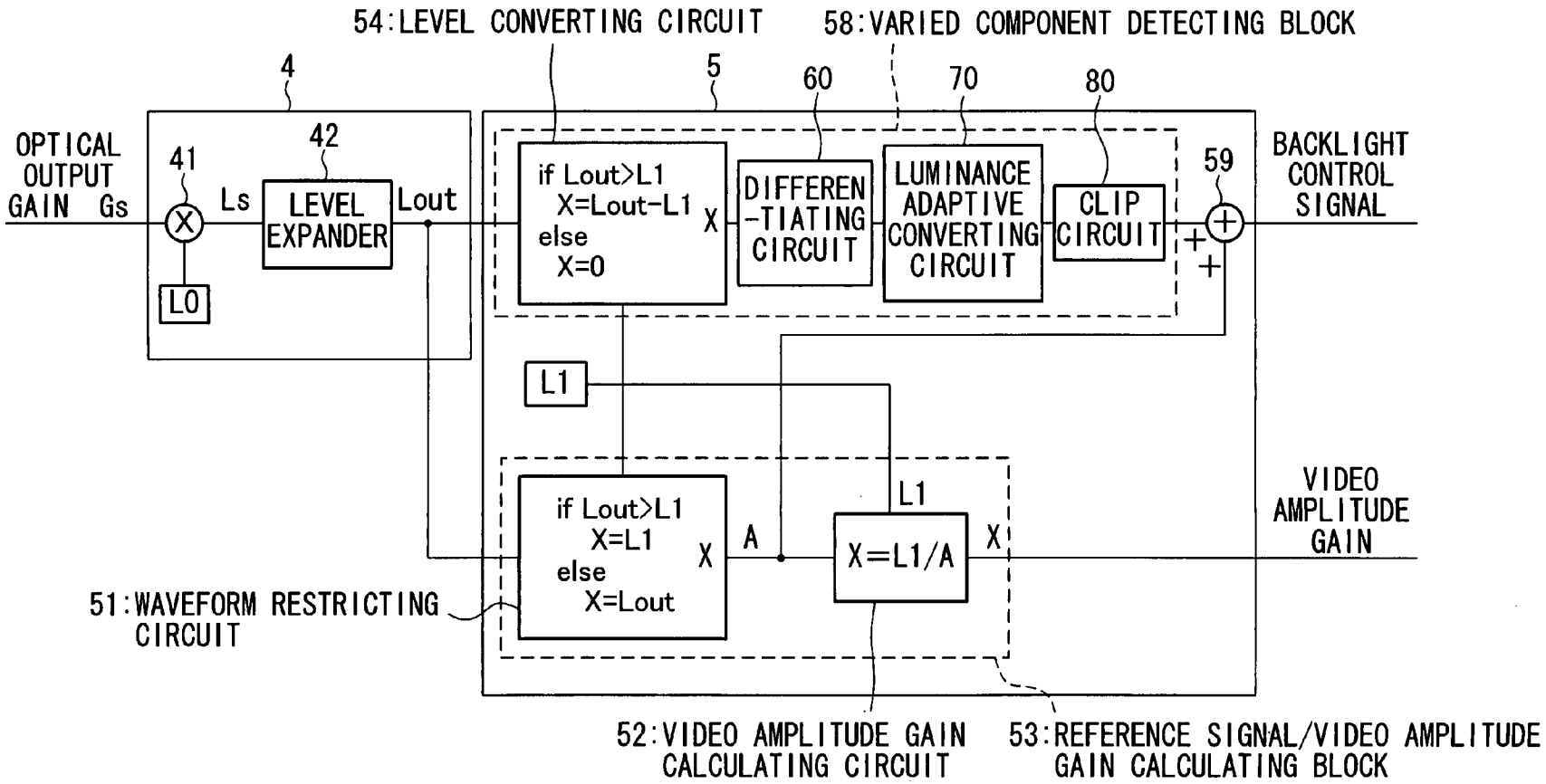
FIG. 2 is a block diagram explaining processes carried out by an optical output control circuit and a white peak improving circuit of the liquid crystal display device.
Figure 3:
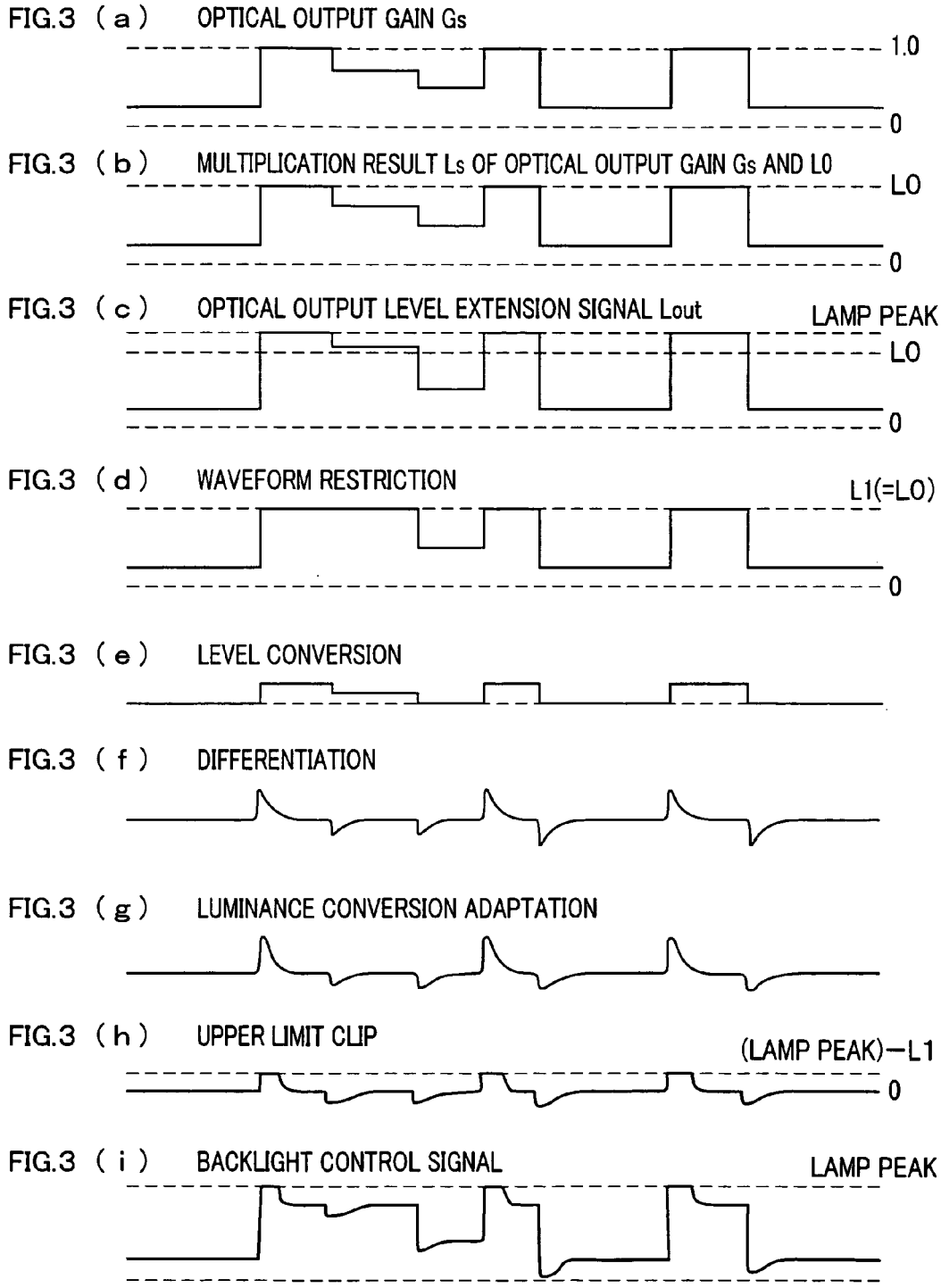
FIG. 3(*a*) through FIG. 3(*i*) are waveform diagrams showing changes in a waveform of an optical output control signal in the optical output control circuit and the white peak improving circuit.

Referring to FIG. 2 and FIG. 3(*a*) through FIG. 3(*i*), the following specifically describes the optical output control circuit 4 and the white peak improving circuit 5 in regard to their structures and operations.

As shown in FIG. 2, the optical output control circuit 4 includes a multiplier 4 and a level extender 42. The white peak improving circuit 5 includes a reference signal/video amplitude gain calculating block 53, a varied component detecting block 58, and an adder 59. The reference signal/video amplitude gain calculating block 53 includes a waveform restricting circuit 51 and a video amplitude gain calculating circuit 52. The varied component detecting block 58 includes a level converting circuit 54, a differentiating circuit 60, a luminance adaptive converting circuit 70, and a clip circuit 80. The adder 59 is provided as adding means.

The optical output gain Gs from the optical output gain calculating circuit 2 is supplied to the adder 41 of the optical output control circuit 4. The input gain value has a waveform as shown in FIG. 3(*a*), for example.

The multiplier 41 calculates the product of the optical output gain value Gs and a common lamp control signal L0 of a predetermined optical output level, so as to obtain a multiplied lamp control signal Ls as shown in FIG. 3(*b*). The common lamp control signal L0, which is a parameter determined according to the rating of the lamp for example, is a control signal that causes the backlight 8 to emit light at constant brightness. Unlike the conventional example, the common lamp control signal L0 does not reduce the brightness of the backlight 8 in a dark scene for the improvement of black contrast, nor does it change the brightness of the backlight 8 according to a change in display brightness as in the present embodiment.

Next, the multiplied lamp control signal Ls is extended to bring the maximum value of the control signal to the peak value of the lamp, so as to obtain an optical output extension signal Lout with a waveform as shown in FIG. 3(*c*). This is carried out to maximize the effect of improved white peak luminance by ensuring that the reference value of the control signal for the backlight 8 in a bright scene coincides with the common lamp control signal L0 after the brightness of the backlight was varied according to a change in brightness of the video scene, and that the increased peak luminance causes the backlight 8 to output its maximum brightness when the maximum allowable current determined by the rating of the backlight 8 is flown.

Then, the optical output level extension signal Lout, which was obtained for the back light 8 by extending the multiplied lamp control signal Ls, is supplied to the white peak improving circuit 5.

The white peak improving circuit 5 processes the signal separately for a bright scene and a scene of normal brightness, and accordingly the optical output level extending signal Lout is supplied to each of the waveform restricting circuit 51 and the level converting circuit 54. It is assumed here that the optical output level extending signal Lout is processed for a bright scene and a scene of normal brightness according to a threshold L1. When there is a change in peak level in a bright scene, the control signal fluctuates above and below the threshold L1, as will be described later. It is therefore preferable that the threshold L1 be used as a normal control signal for the backlight 8. That is, the threshold L1 is preferably equal to the normal lamp control signal L0.

In the waveform restricting circuit 51, the optical output level extension signal Lout is clipped at the threshold L1 to obtain a reference signal for the backlight control signal. FIG. 3(*d*) shows an output waveform of the waveform restricting circuit 51 when the threshold L1=normal lamp control signal L0.

On the other hand, in the level converting circuit 54, the threshold L1 is subtracted from the optical output level extension signal Lout. From the result of subtraction, only the positive component is extracted to obtain a control signal waveform for a bright scene. FIG. 3(*e*) shows an output waveform of the level converting circuit 54 when the threshold L1=normal lamp control signal L0.

The output of the level converting circuit 54 is differentiated with a time constant set in the differentiator circuit 60, so as to determine an amount of change in the level of the control signal in a bright scene.

Figure 4:
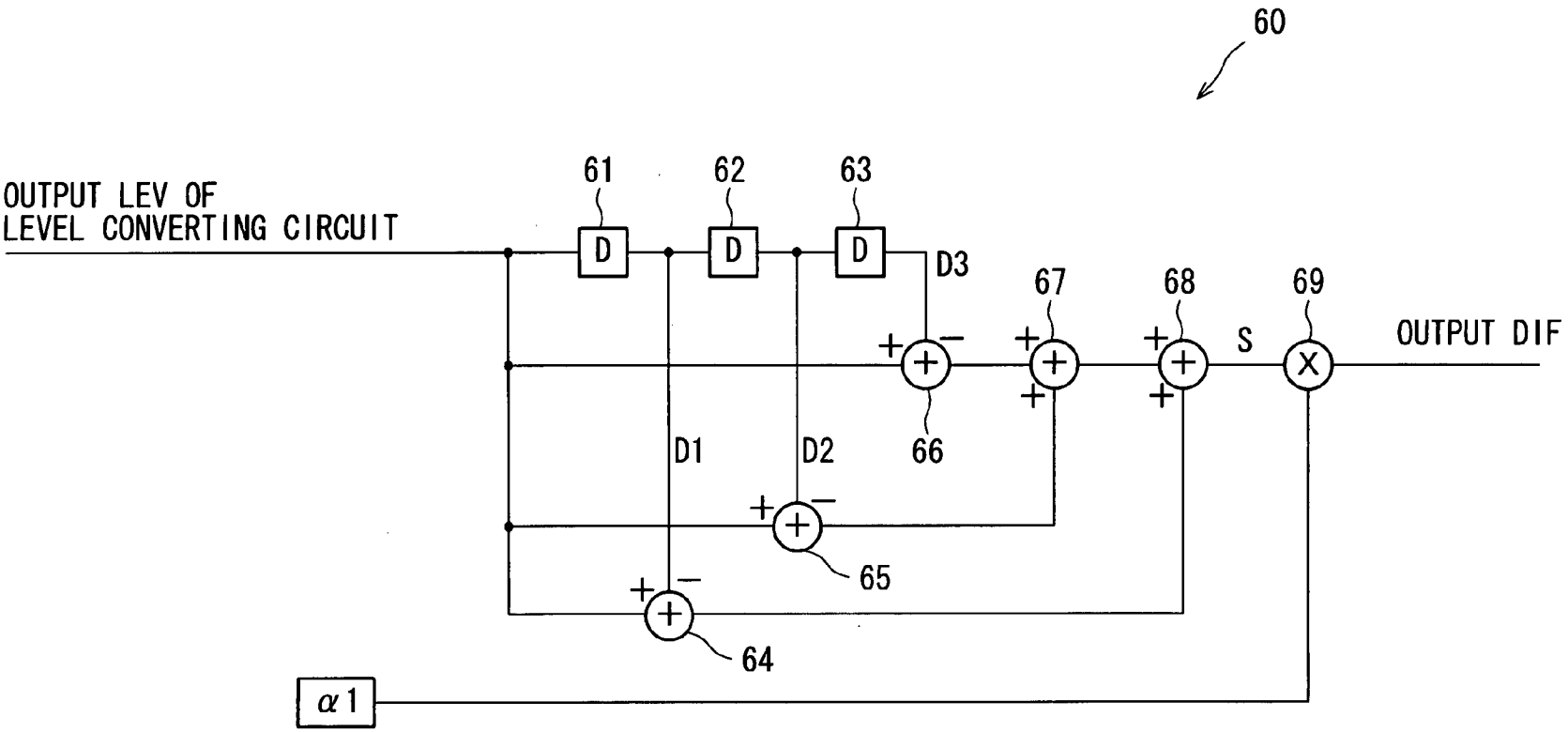
FIG. 4 is a block diagram showing a structure of a differentiating circuit provided in the white peak improving circuit.

The differentiating circuit 60 includes, for example, delay circuits 61, 62, and 63, adders 64, 65, 66, 67, and 68, and a multiplier 69, as shown in FIG. 4.

The delay circuits 61, 62, and 63 store data during certain intervals of time, for example, such as a vertical synchronous period. The output LEV of the level converting circuit 54 is supplied to the delay circuit 61, and the output D1 of the delay circuit 61 is supplied to the delay circuit 62. The output D2 of the delay circuit 62 is supplied to the delay circuit 36 to obtain an output D3.

The adders 64, 65, and 66 calculate a difference between the respective outputs D1, D2, and D3 and the output LEV of the level shifting circuit 54. The adders 67 and 68 add the differences to obtain a sum S of the differences. The multiplier 69 multiplies the sum S by a coefficient al to obtain an output DIF.

Preferably, the number of delay circuits is greater than three, even though only three delay circuits 61, 62, and 63 are provided in this example. For example, when 10 delay circuits are provided that can store data for 1 second, all the past changes in peak level are reflected except for those that have occurred in the last 10 seconds. In terms of visual perception, it is preferable that the brightness of the backlight 8 that was varied according to a change in peak level returns to the normal brightness within several seconds to several ten seconds. To this end, the backlight 8 is adjusted according to the duration in which the data is kept, as well as the number of delay circuits, so as to bring about an optimum change.

Figure 5A:
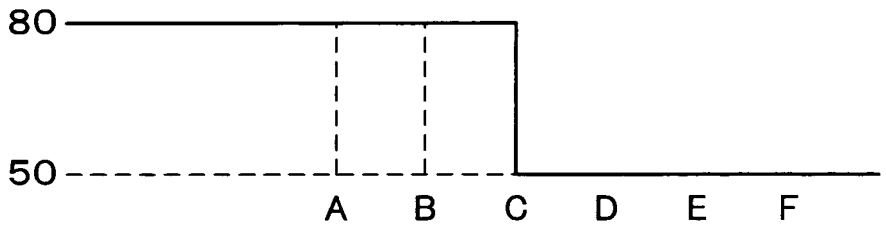
FIG. 5(*a*) is a waveform diagram representing an output of a level converting circuit provided in the white peak improving circuit, and FIG. 5(*b*) is a waveform diagram representing an output of a differentiating circuit provided in the white peak improving circuit.
Figure 5B:
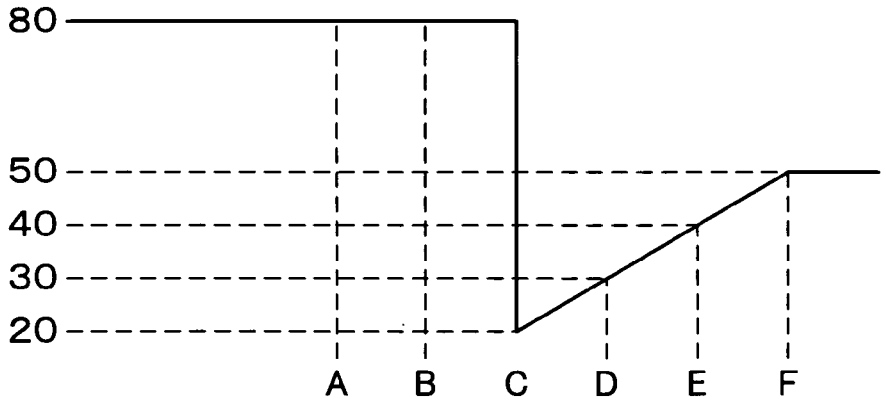

Here, with a coefficient $\alpha 1=0.3$, differentiation of the input waveform as shown in FIG. 5(*a*) produces the waveform shown in FIG. 5(*b*), facilitating the change in brightness at point (C). Over time, the brightness gradually returns to the original level by passing through points (D), (E), and (F).

By varying the quantity of the optical output of the lamp according to the output level of the differentiating circuit 60, the brightness of the lamp can be temporarily increased in a bright scene, thereby increasing the white peak level. This change occurs not only in a dark-to-bright transition but also bright-to-dark transition as well.

However, changing the optical output level equally in the bright-to-dark transition and dark-to-bright transition is problematic because the effect of the change is greater in the former and thereby causes poor display quality. In order to avoid this, the luminance adaptive converting circuit 70 brings the amount of change of the output light from the lamp to a suitable level, as shown in FIG. 3(*g*). Specifically, the luminance adaptive converting circuit 70 sets a coefficient for each of the positive and negative components of the differentiation result obtained by the differentiating circuit 60, and the upper limit of the varied component is clipped in the clip circuit 80 of the next stage, so as to prevent the control signal from exceeding the peak of the lamp, as shown in FIG. 3(*h*). The waveform shown in FIG. 3(*g*) was obtained by multiplying the positive component by 1.5, and the negative component by 0.6.

The luminance adaptive converting circuit 70 is described below in more detail.

Figure 6:
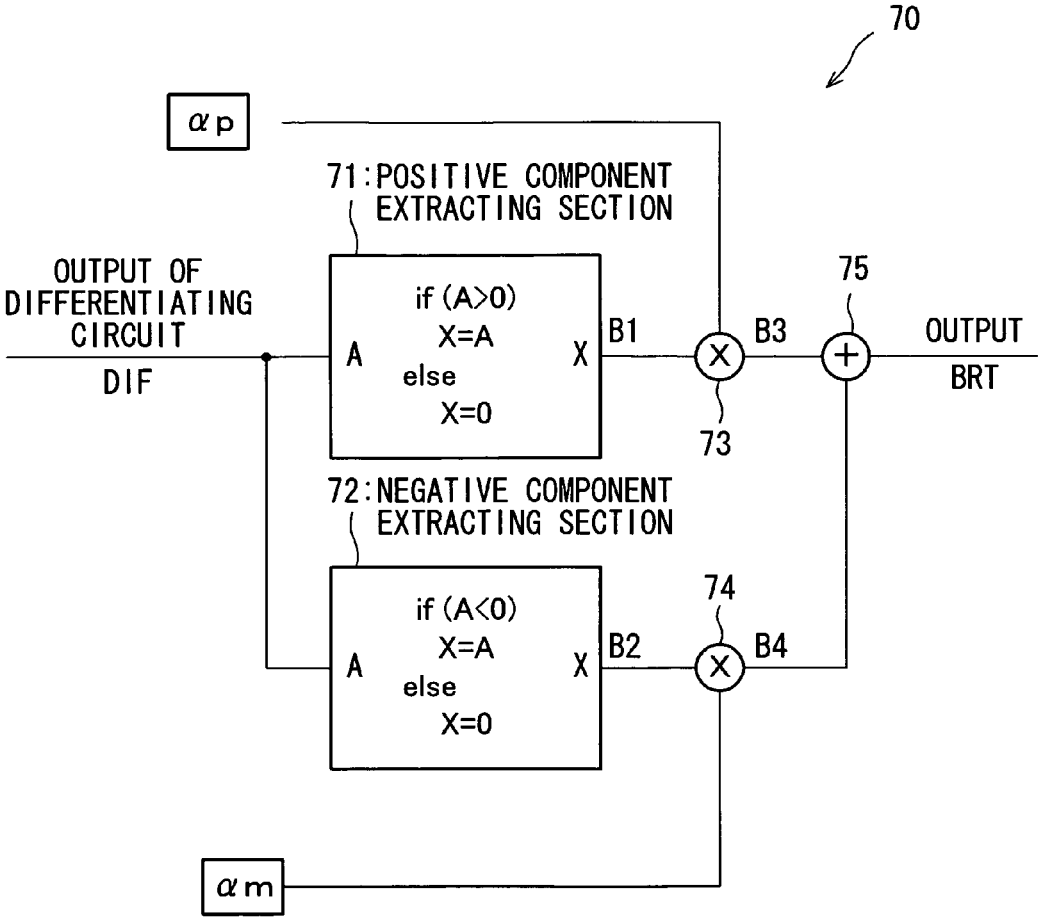
FIG. 6 is a block diagram showing a structure of a luminance adaptive converting circuit provided in the white peak improving circuit.

As illustrated in FIG. 6, the luminance adaptive converting circuit 70 includes a positive component extracting section 71, a negative component extracting section 72, multipliers 73 and 74, and an adder 75.

In the luminance adaptive converting circuit 70, the positive component extracting section 71 and the negative component extracting section 72 respectively extract the positive component and negative component of the output DIF from the differentiating circuit 60, and output a positive component B1 and a negative component B2, respectively. The multiplier 73 multiplies the positive component B1 by a coefficient $\alpha p$ to obtain an output B3. The multiplier 74 multiplies the negative component B2 by a coefficient am to obtain an output B4. The adder 75 adds the output B3 and output B4 to obtain an output BRT.

FIG. 7(*a*) through FIG. 7(*d*) show the end results of the operation carried out by the luminance adaptive converting circuit 70 when the coefficient $\alpha p=1.2$ and the coefficient $\alpha m=0.6$. In the case where the brightness is varied spontaneously, a bright-to-dark transition produces a signal that is more conspicuous than that produced by a dark-to-bright transition, provided that the amount of change is the same. This can be understood in terms of brightness ratio. For example, a dark-to-bright transition from 100 cd/m$^2$ to 150 cd/m$^2$ by an increment of 50 cd/m$^2$ has a luminance ratio of 3:2, whereas a bright-to-dark transition from 100 cd/m$^2$ to 50 cd/m$^2$ by a decrement of 50 cd/m$^2$ has a luminance ratio of 2:1. Thus, in spontaneously changing the brightness of the backlight, it is preferable to adaptively convert the luminance by weighting the positive change more than the negative change.

By thus independently processing the positive and negative components of the output DIF from the differentiating circuit 60, luminance can be adaptively converted to provide more natural display.

Then, the adder 59 shown in FIG. 2 adds a reference signal A, which is the output of the waveform restricting circuit 51, to an output CLP produced by upper-limit clipping by the clip circuit 80, and outputs the sum as a backlight control signal as shown in FIG. 3(*i*). The output is supplied to the backlight operating circuit 6 shown in FIG. 1 so as to adjust lamp luminance.

The clip circuit 80 is described below in more detail.

Figure 8:
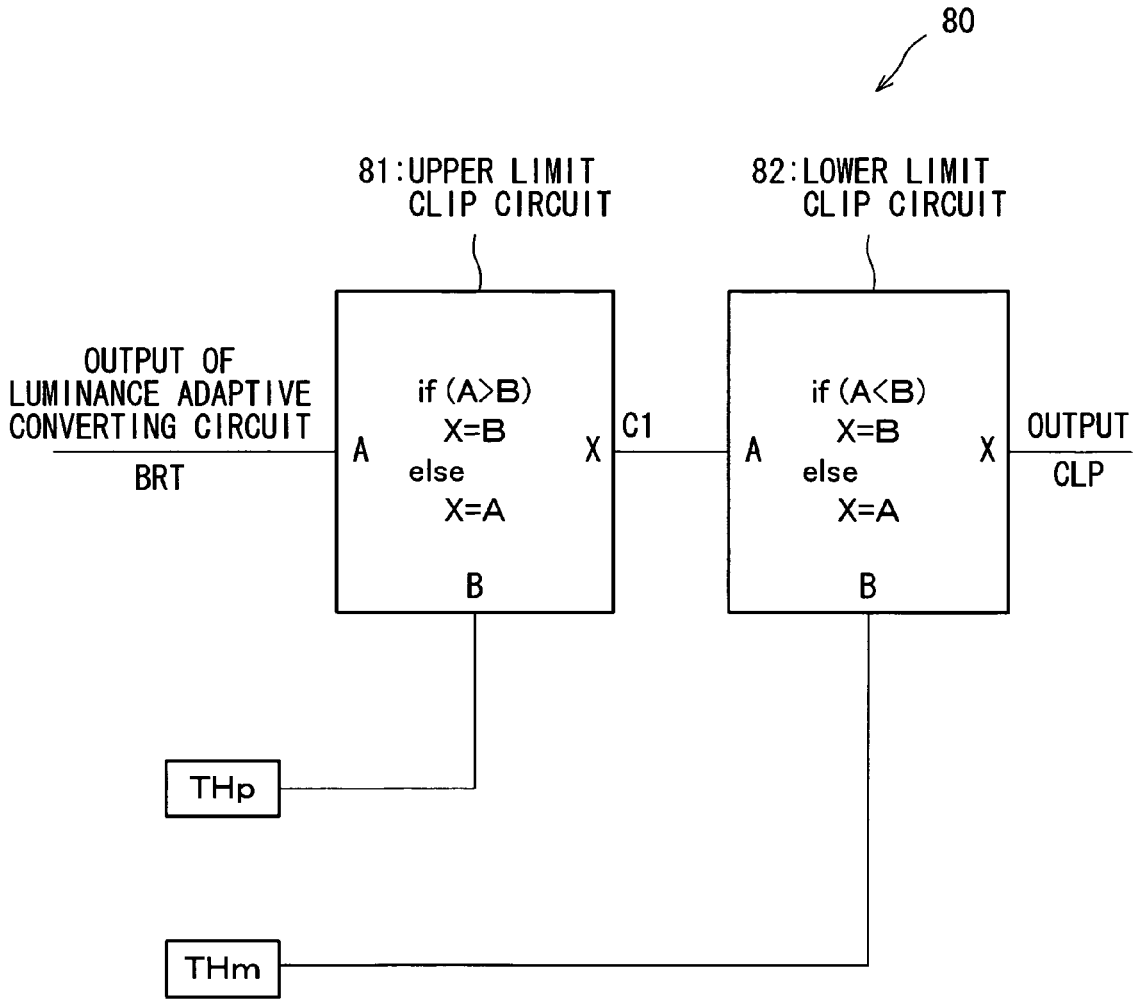
FIG. 8 is a block diagram illustrating a structure of a clip circuit provided in the white peak improving circuit.

As illustrated in FIG. 8, the clip circuit 80 includes an upper limit clip circuit 81 and a lower limit clip circuit 82, which are connected to each other in series.

In the clip circuit 80, the output BRT of the luminance adaptive converting circuit 70 is supplied to the upper limit clip circuit 81. The upper limit clip circuit 81 clips a signal that exceeds a threshold THp, and outputs an output C1 to the lower limit clip circuit 82. The lower limit clip circuit 82 clips a signal below a threshold THm, and produces an output CLP.

For example, when the threshold THp=10, and THm=−10, the waveform as shown in FIG. 9(*a*) is clipped as shown in FIG. 9(*b*).

Meanwhile, based on the reference signal A with its upper limit clipped by the waveform restricting circuit 51, the video amplitude gain calculating circuit 52 shown in FIG. 2 calculates a gain value for adjusting a video amplitude and outputs the result of calculation to the gain variable amplifier circuit 3 shown in FIG. 1. Note that, the backlight operating circuit 6, the liquid crystal driving circuit 7, the backlight 8, and the liquid crystal panel 9 will not be described in regard to their operations, since they are known.

As shown in FIG. 1, the optical output control circuit produced by the white peak improving circuit 5 is supplied to the backlight operating circuit 6, and the luminance of the backlight 8 is adjusted based on the optical output control signal. In this way, high-quality display can be obtained with improved contrast in a dark scene and improved white peak luminance in a bright scene.

Here, the process of facilitating a change in brightness that is carried out when the peak level of display turns dark may be omitted by setting a coefficient $\alpha m=0$ in the luminance adaptive converting circuit 70 shown in FIG. 6. FIG. 10(*a*) through FIG. 10(*i*) show different waveforms of the optical output control signal when the coefficient $\alpha m=0$. FIG. 10(*a*) through FIG. 10(*i*) are analogous to FIG. 3(*a*) through FIG. 3(*i*), and accordingly further explanations thereof are omitted here. It can be seen that a change in brightness is not facilitated in the negative direction.

Table 1 represents changes in display brightness with respect to the input when the video amplitude gain of the present embodiment was used. For comparison, Table 2 represents changes in display brightness with respect to the input when a conventional gain was used.

TABLE 1

Display brightness with respect to the input when the amplitude gain of the present embodiment was used

| VIDEO AMPLITUDE GAIN OF THE PRESENT EMBODIMENT | AMPLITUDE OF VIDEO SIGNAL AMPLIFIED WITH THE VIDEO AMPLITUDE GAIN (AMPLITUDE × VIDEO AMPLITUDE GAIN) | BACKLIGHT CONTROL SIGNAL BEFORE EXTENSION | BACKLIGHT CONTROL SIGNAL EXTENDED 1.5 TIMES AND CLIPPED AT L0 | BRIGHTNESS RATIO OF DISPLAY WITH RESPECT TO INPUT VIDEO |
|---|---|---|---|---|
| 1/0.75 | VIDEO SIGNAL AMPLITUDE/0.75 | 0.5 × L0 | 0.75 × L0 | 1 |
| 1/0.9 | VIDEO SIGNAL AMPLITUDE/0.9 | 0.6 × L0 | 0.9 × L0 | 1 |
| 1.0 | VIDEO SIGNAL AMPLITUDE | 0.7 × L0 | L0 | 1 |
| 1.0 | VIDEO SIGNAL AMPLITUDE | 0.8 × L0 | L0 | 1 |
| 1.0 | VIDEO SIGNAL AMPLITUDE | 0.9 × L0 | L0 | 1 |
| 1.0 | VIDEO SIGNAL AMPLITUDE | L0 | L0 | 1 |

TABLE 2

Display brightness with respect to the input when a conventional gain was used

| CONVENTIONAL GAIN | AMPLITUDE OF VIDEO SIGNAL AMPLIFIED WITH CONVENTIONAL GAIN (AMPLITUDE × GAIN) | BACKLIGHT CONTROL SIGNAL BEFORE EXTENTION | BACKLIGHT CONTROL SIGNAL EXTENDED 1.5 TIMES AND CLIPPED AT L0 | BRIGHTNESS RATIO OF DISPLAY WITH RESPECT TO INPUT VIDEO |
|---|---|---|---|---|
| 0.5 | VIDEO SIGNAL AMPLITUDE/0.5 | 0.5 × L0 | 0.75 × L0 | 1.5 |
| 0.6 | VIDEO SIGNAL AMPLITUDE/0.6 | 0.6 × L0 | 0.9 × L0 | 1.5 |
| 0.7 | VIDEO SIGNAL AMPLITUDE/0.7 | 0.7 × L0 | L0 | 1/0.7 |
| 0.8 | VIDEO SIGNAL AMPLITUDE/0.8 | 0.8 × L0 | L0 | 1/0.8 |

TABLE 2-continued

| | Display brightness with respect to the input when a conventional gain was used | | | |
|---|---|---|---|---|
| CONVENTIONAL GAIN | AMPLITUDE OF VIDEO SIGNAL AMPLIFIED WITH CONVENTIONAL GAIN (AMPLITUDE × GAIN) | BACKLIGHT CONTROL SIGNAL BEFORE EXTENTION | BACKLIGHT CONTROL SIGNAL EXTENDED 1.5 TIMES AND CLIPPED AT L0 | BRIGHTNESS RATIO OF DISPLAY WITH RESPECT TO INPUT VIDEO |
| 0.9 | VIDEO SIGNAL AMPLITUDE/0.9 | 0.9 × L0 | L0 | 1/0.9 |
| 1.0 | VIDEO SIGNAL AMPLITUDE/1.0 | L0 | L0 | 1 |

As thus far described, the liquid crystal display device of the present embodiment is an improvement over the conventional liquid crystal display device by additionally including the white peak improvement circuit 5 and by replacing the amplitude modulating circuit, provided as modulating means, with the gain variable amplifier circuit 3.

The white peak improving circuit 5 receives the optical output level extension signal Lout from the optical output control circuit 4 of the level extension signal calculating circuit 11, modulates the optical output level extension signal Lout to improve white peak luminance, and outputs the backlight control signal to the backlight operating circuit 6. Further, the white peak improving circuit 5 calculates a video amplitude gain, which is a coefficient for amplifying the video amplitude, and outputs it to the gain variable amplifier circuit 3 of the gain variable liquid crystal driving circuit 10.

Based on the input video amplitude gain, the gain variable amplifier circuit 3 amplifies the video signal, and outputs the amplified video signal to the liquid crystal driving circuit 7.

In this way, when the input video is of a scene brighter than normal brightness, a change in brightness of the scene is detected from a time-dependent change in peak level of the video signal, so as to spontaneously control the output light of the lamp according to the change in brightness of the scene. As a result, white peak luminance is improved as visually perceived by a viewer.

Thus, the provision of the white peak improving circuit 5 in a conventional contrast improving circuit realizes a liquid crystal display device that can improve peak luminance in a bright scene and can suppress pale black display in a dark scene and thereby provide a wide dynamic range without increasing power consumption.

In the liquid crystal display device of the present embodiment, the white peak improving circuit 5 includes the varied component detecting block 58, the reference signal/video amplitude gain calculating block 53, and the adder 59 which adds the output of the varied component detecting block 58 and the reference signal A of the backlight control signal, and outputs the sum as a backlight control signal. The varied component detecting block 58 detects a component of brightness change, and calculates a correction signal for the backlight control signal so as to facilitate the brightness change. The reference signal/video amplitude gain calculating block 53 calculates a reference signal A for the backlight control signal, and a video amplitude gain.

Thus, with an input video of a bright scene, the brightness of the backlight 8 is spontaneously increased when there is a large peak level change, and is spontaneously reduced when there is a small peak level change. As a result, a change in brightness is facilitated, and white peak luminance is improved as perceived by a viewer. Further, the backlight is controlled differently depending on whether the input video is of a bright scene or of a scene of normal brightness, preventing the backlight 8 from spontaneously changing its brightness even when the brightness of the scene is changed at low level. This ensures the stability of black display in a dark scene, thereby suppressing pale black display.

In the liquid crystal display device of the present embodiment, the varied component detecting block 58 includes the level converting circuit 54, the differentiating circuit 60, the luminance adaptive converting circuit 70, and the clip circuit 80. When the input video signal is of a relatively bright scene, the varied component detecting block 58 detects a component that has been varied with a time-dependent change in peak level, so as to calculate a correction signal for the backlight control signal and thereby facilitate the change in display brightness of a relatively bright scene.

Specifically, in the level converting circuit 54, a threshold is subtracted from the optical output level extension signal Lout produced by the optical output control circuit 4, and only the positive component is extracted from the result of calculation so as to obtain a waveform of the optical output level extension signal Lout for a relatively bright scene.

That is, the white peak improving circuit 5 determines whether the input video is of a relatively bright scene or of a scene of normal brightness, and facilitates a change in brightness of the peak level when the input video is of a bright scene.

The differentiating circuit 60 differentiates the output of the level converting circuit 54 with a certain time constant, and detects a varied component of the optical output level extension signal Lout in a relatively bright scene. Further, by setting a suitable time constant, the differentiating circuit 60 controls the time-dependent change in brightness of the backlight 8 so that the change appears natural to a viewer. This enables the white peak improving circuit 5 to extract a varied component of the peak level when the input video is of a bright scene. Further, by setting a suitable time constant, a time-dependent change in brightness of the backlight 8 appears natural to a viewer.

The luminance adaptive converting circuit 70 multiples a varied component of the output peak level of the differentiating circuit 60 by a time constant, so that the amount of change in the backlight 8 appears natural to a viewer. Further, the luminance adaptive converting circuit 70 independently sets a coefficient for the positive and negative components of a varied component so that the positive and negative components are independently multiplied by their respective coefficients. In this way, a change in brightness in a dark-to-bright transition and a change in brightness in a bright-to-dark transition are independently controlled such that the change appears naturally to a viewer in both transitions. For example, the coefficient that multiplies the negative component may be set to 0 when a change in brightness in a bright-to-dark transition needs not to be facilitated.

The clip circuit 80 is provided to clip the upper limit and lower limit of the control signal for the backlight 8, so that a current that flows into the backlight 8 does not exceed a rated value when the control signal for the backlight 8 is corrected.

By the provision of the foregoing circuits, the varied component detecting block 58 calculates a correction signal for the backlight control signal, so as to facilitate a change in display brightness.

Thus, the varied component detecting block 58, with its constituting circuits, calculates a correction signal for the backlight control signal to ensure that a change in brightness is facilitated when the input video is of a relatively bright scene.

In the liquid crystal display device of the present embodiment, the reference signal/video amplitude gain calculating block 53 includes the waveform restricting circuit 51 and the video amplitude gain calculating circuit 52. With these circuits, the reference signal/video amplitude gain calculating block 53 calculates a reference signal A for the backlight control signal, and a video amplitude gain.

That is, signals are produced that control the backlight 8 and the video signal, enabling the backlight 8 and the video amplitude to be controlled without causing unnaturalness in the brightness of the output video.

Specifically, the waveform restricting circuit 51 uses the threshold L1 to clip the optical output level extension signal Lout supplied from the optical output control circuit 4, and calculates the reference signal A for the backlight control signal. Preferably, the threshold L1 is one used in the level converting circuit 54 of the varied component detecting block 58. In this way, the white peak improving circuit 5 determines whether the input video is of a relatively bright scene or of a scene of normal brightness, and carries out the control of not facilitating the change in brightness when the input video is of normal brightness, thereby suppressing pale black display in a dark scene.

Note that, the reference signal A for the backlight control signal is a backlight control signal from which a component for facilitating a change in display brightness has been removed.

The video amplitude gain calculating circuit 52 is a circuit for calculating a coefficient that amplifies the video signal according to the reference signal for the backlight control signal. By calculating a coefficient for adjusting the amplitude of the video signal, the video amplitude can be controlled without causing unnaturalness in the brightness of the output video.

In the adder 59, the correction signal for the backlight control signal, which was calculated by the varied component detecting block 58, is added to the reference signal A for the backlight control signal. Then, the adder 59 outputs a backlight control signal to enable the backlight operating circuit 6 to control the backlight 8 in such a manner as to improve the peak level by facilitating a change in display brightness. The video amplitude gain is supplied to the gain variable amplifier circuit 3, and is multiplied by a video signal to amplify the video signal. The resulting video signal is supplied to the liquid crystal driving circuit 7.

The method adjusts a control signal for the lamp according to a change in display brightness in a bright scene. In a dark scene, a conventional control signal is used to improve black contrast. In this way, white peak can be improved in a bright scene without causing pale black display in a dark scene.

Further, the method can provide a wider dynamic range than the conventional method, because the minimum luminance that can be displayed in the liquid crystal display device is equal to the minimum luminance of conventional methods when the white peak luminance is not improved, and because the maximum luminance that can be displayed in the liquid crystal display device is equal to the maximum luminance of the conventional method when the white peak luminance is improved.

In improving white peak luminance, the conventional method turns on the lamp above a normal brightness so that the peak luminance is improved throughout a bright scene. In contrast, in the present embodiment, the brightness of the backlight 8 is merely increased spontaneously when the peak level of the video signal increases, thereby reducing power consumption than conventionally in improving white peak.

As used herein in conjunction with the display apparatus of the present invention, the term "brightness" is used to refer to a parameter that indicates the brightness of a video frame calculated from the pixel information of the video, irrespective of the signal type.

It is therefore preferable that the brightness, for example, is based on a parameter indicative of brightness, such as the maximum value, mean value, or minimum value of yellow (Y) in a video frame.

It is also preferable that the brightness is based on a combination of RGB values, which are parameters indicative of brightness, and that the brightness of the brightest pixel in the video frame be used as the brightness of a video frame.

Further, it is preferable that the brightness is the upper predetermined percent (e.g., upper 10 percent) of pixel brightness obtained from a histogram of parameters that indicate the brightness of a video frame.

Further, instead of determining the brightness from the information of only a single video frame, the brightness is preferably determined by taking into account the information of the previous video frame.

It is also preferable that a scene of normal brightness and a scene brighter than normal brightness be separated from each other by a threshold.

[Second Embodiment]

Figure 11:
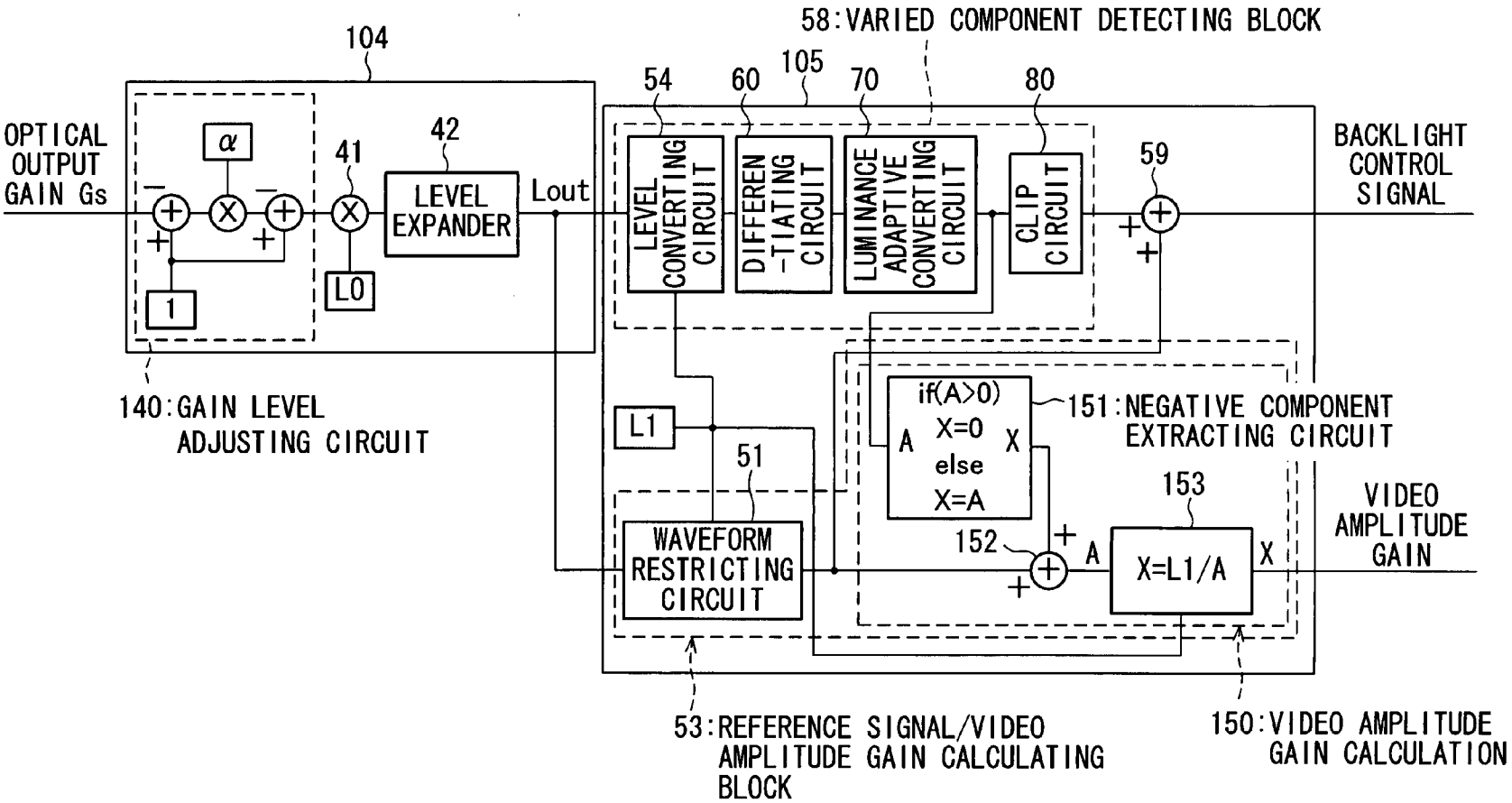
FIG. 11 is a block diagram explaining processes carried out by the optical output control circuit and the white peak improving circuit in another embodiment of the liquid crystal display device of the present invention.
Figure 13:
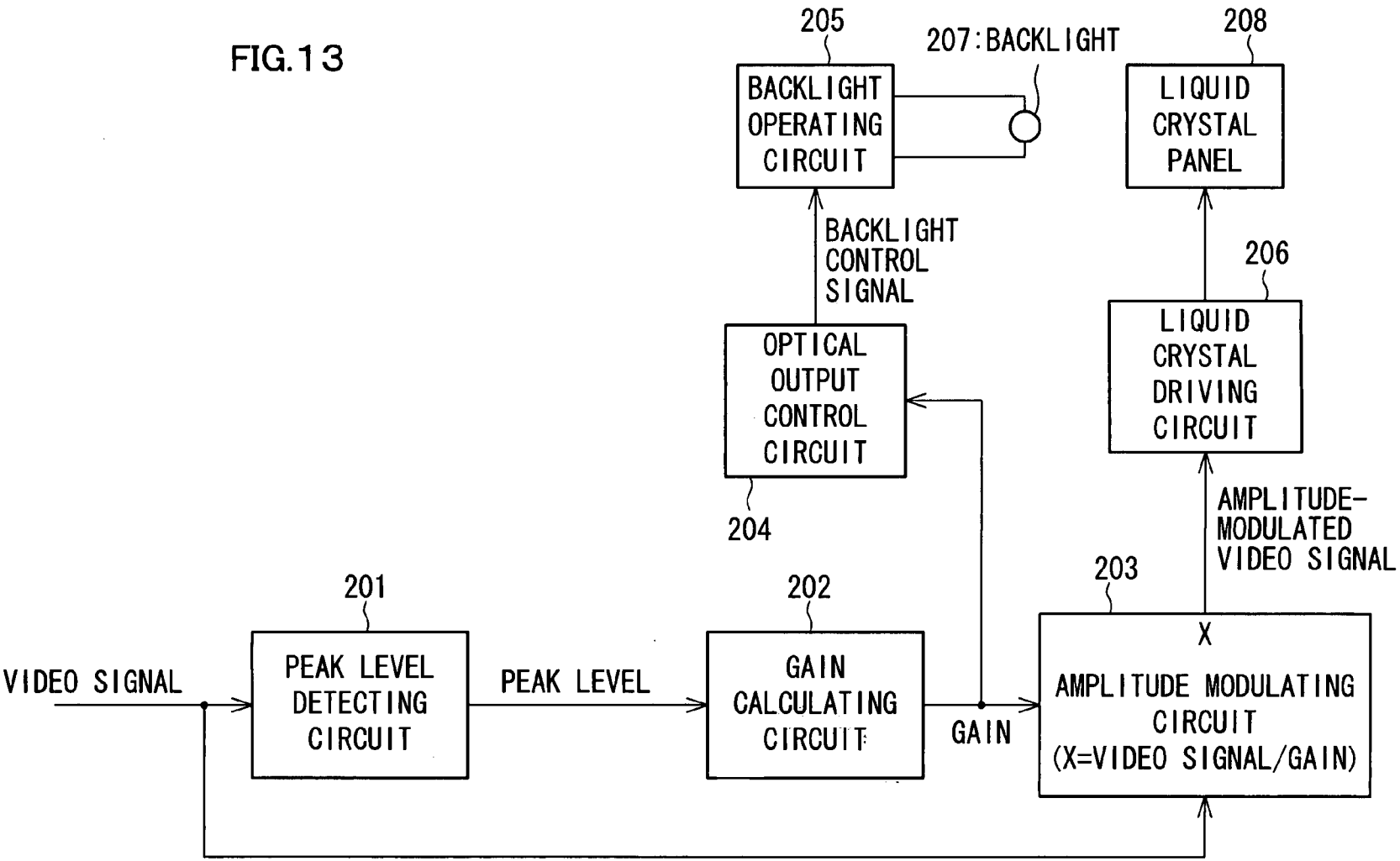
FIG. 13 is a block diagram illustrating a white peak improving circuit of a conventional liquid crystal display device.

The following will describe another embodiment of the present invention with reference to FIG. 11 and FIG. 12. Note that, for convenience of explanation, constituting elements having the same functions as those described in the First Embodiment are given the same reference numerals and further explanations thereof are omitted here.

For the overall structure of a liquid crystal display device according to the present embodiment, FIG. 1 of the First Embodiment should be referred to. However, the liquid crystal display device of the present embodiment differs from that of the First Embodiment in the operations of the optical output control circuit 4 and the white peak improving circuit 5. Namely, the luminance adaptive converting circuit 70 of the First Embodiment shown in FIG. 6 sets a coefficient $\alpha m=0$ so as not to facilitate a change in brightness in the negative direction. Likewise, a change in brightness in the negative direction is not facilitated either in the present embodiment.

FIG. 11 illustrates exemplary structures of an optical output control circuit 104 and a white peak improving circuit 105 of the present embodiment.

The optical output control circuit 104 of the present embodiment differs from its counterpart in the First Embodiment in that a gain level adjusting circuit 104 is provided in front of the multiplier 41.

Further, the white peak improving circuit 105 of the present embodiment differs from its counterpart in the First Embodiment in that the reference signal/video amplitude gain calculating block 53 has a video amplitude gain calculating circuit 105 that includes a negative component extracting circuit 151, an adder 152, and a divider 153.

The optical output control circuit 104 receives the optical output gain value Gs produced by the optical output gain calculating circuit 2 described in the First Embodiment with reference to FIG. 1. The optical output gain value Gs is supplied to the gain level adjusting circuit 140, level-converted, and multiplied by a normal lamp control signal in the multiplier 41. The result of multiplication is supplied to the level extender 42 and level-expended therein before it is supplied to the waveform restricting circuit 51 and the level converting circuit 54 of the white peak improving circuit 105.

The output of the level shifting circuit 54 is differentiated by the differentiating circuit 60, and is supplied to the luminance adaptive converting circuit 70. The output of the luminance adaptive converting circuit 70 is supplied to the clip circuit 80, and the negative component extracting circuit 151 of the video amplitude gain calculating circuit 150.

The output of the clip circuit 80 is added in the adder 59 to the output of the waveform restricting circuit 51, and is outputted as a backlight control signal. The output of the negative component extracting circuit 151 is added in the adder 152 to the waveform restricting circuit 51, supplied to the divider 153, and outputted as a video amplitude gain.

In the following, the optical output control circuit 104 and the white peak improving circuit 105 will be described in more detail in regard to their operations.

First, the optical output gain value supplied to the optical output control circuit 104 is level-converted by the gain level adjusting circuit. The gain level adjusting circuit 140 is provided for the correction of the optical output gain value Gs produced by the optical output gain calculating circuit 2 as shown in FIG. 1, such that the optical output gain value Gs approaches 1, using a coefficient $\alpha$ that satisfies $0<\alpha<1.0$.

Note that, no explanations will be given for the multiplier 41, the level expender 42, the level converting circuit 54, the differentiating circuit 60, the luminance adaptive converting circuit 70, and the clip circuit 80, because these elements are the same as their respective counterparts shown in FIG. 2.

The negative component extracting circuit 151 of the video amplitude gain calculating circuit 150 clips the positive component of the output of the luminance adaptive converting circuit 70. The output of the negative component extracting circuit 151 is supplied to the divider 153 after it is added in the adder 152 to the output of the waveform restricting circuit 51. The divider 153 divides the threshold L1 by the result of addition carried out by the adder 152, and outputs a video amplitude gain. The reason the threshold L1 is divided by the result of addition carried out by the adder 152 is to take an inverse of the division that divides the result of addition of the adder 152 by the threshold L1. FIG. 12(*a*) through FIG. 12(*d*) show the outputs of the respective circuits.

As described, in the liquid crystal display device of the present embodiment, the varied component detecting block 58 of the white peak improving circuit 105 adjusts the amplitude of a varied component of the peak level to facilitate a change in brightness and thereby cause a spontaneous change in brightness of the backlight 8. When the peak level is changed from dark to bright, the varied component detecting block 58 adjusts the amplitude in such a manner that the brightness change does not appear unnatural. On the other hand, when the peak level is changed from bright to dark, the varied component detecting block 58 spontaneously amplifies the video amplitude by an amount that compensates for the spontaneous decrease in brightness of the backlight 8. With this control, a change in brightness does not cause a spontaneous reduction of display brightness.

Thus, with the white peak improving circuit 105 that independently carries out level conversion for the respective amplitudes of the positive and negative components of the varied component of the output peak level of the differentiating circuit 60, the process of spontaneously varying the brightness of the backlight 8 by facilitating a change in brightness can be carried out without causing unnaturalness in display brightness.

Further, in the liquid crystal display device of the present embodiment, a coefficient for suitably adjusting the amplitude of a video signal is calculated according to the result of addition of the control signal of the backlight 8 to the negative component of the output of the luminance adaptive converting circuit 70. In this way, the video amplitude can be adjusted and controlled without causing unnaturalness to the output display brightness. Further, with the coefficient, the video amplitude may be controlled so as not to facilitate a change in brightness when the peak level has changed from bright to dark.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

INDUSTRIAL APPLICABILITY

The present invention realizes a display apparatus that improves peak luminance in a bright scene and suppresses pale black display in a dark scene and thereby provides a wide dynamic range without increasing power consumption.

The present invention is therefore applicable to various types of display apparatuses, including a liquid crystal display device and a projection-type liquid crystal projector, for example.

The invention claimed is:

1. A display apparatus comprising:

a display panel;

coefficient variable driving means for driving the display panel with an amplified video signal that is obtained by multiplying an input video signal by a variable coefficient;

operating means for operating, based on a lamp control signal, a lamp for illuminating the display panel;

level extension signal calculating means for outputting an optical output level extension signal by extending a predetermined output level used to operate the lamp, wherein the predetermined output level is extended based on an optical output gain obtained from the input video signal, and an output peak value of the lamp; and white peak improving means for receiving the optical output level extension signal, and for outputting a lamp control signal, whose white peak level has been adjusted according to a change in brightness of a scene, to the operating means, and for calculating and outputting a video amplitude gain, which adjusts an amplitude of a video signal, as a coefficient to the gain variable driving means, wherein the lamp control signal is outputted when the brightness of a scene is above normal level, and the video amplitude gain is outputted when the brightness is at normal level.

2. The display apparatus as set forth in claim 1, wherein the coefficient variable driving means includes:

gain variable amplifying means for amplifying a video amplitude by obtaining a product of the video coefficient gain, which is a coefficient calculated by the white peak improving means, and the input video signal, and outputting the amplified video amplitude to driving means; and driving means for driving the display panel according to the amplified video amplitude.

3. The display apparatus as set forth in claim 1, wherein the level extension signal calculating means includes:

peak level detecting means for detecting a peak level of the input video signal during certain intervals of time;

optical output gain calculating means for producing an optical output gain by calculation from the peak level detected by the peak level detecting means; and optical output control means for outputting the optical output level extension signal such that a maximum value of products obtained by multiplying the optical output gain of the optical output gain calculating means by a predetermined optical output level for operating the lamp coincides with a peak value of the lamp.

4. The display apparatus as set forth in claim 1, wherein the white peak improving means includes:

a varied component detecting block for detecting a varied component of brightness, and calculating a correction signal for the lamp control signal so as to facilitate a change in brightness;

a reference signal/video amplitude gain calculating block for calculating a reference signal for the lamp control signal, and the video amplitude gain; and adding means for adding the output of the varied component detecting block and the reference signal for the lamp control signal, and outputting a result of calculation as the lamp control signal.

5. The display apparatus as set forth in claim 4, wherein the varied component detecting block includes:

a level converting circuit for subtracting a predetermined threshold from the optical output level extension signal outputted from the optical output control means, so as to output a positive component of a subtraction result;

a differentiating circuit for differentiating an output signal of the level converting circuit with a certain time constant;

a luminance adaptive converting circuit for multiplying the output of the differentiating circuit by a predetermined coefficient which is set for each of a positive component and a negative component of the output of the differentiating circuit, so as to calculate a signal for controlling a light quantity of the operating means; and a clip circuit for clipping an upper limit of the output of the luminance adaptive converting circuit, so as to prevent the lamp control signal from being outputted above the peak of the lamp.

6. The display apparatus as set forth in claim 4, wherein the reference signal/video amplitude gain calculating block includes:

a waveform restricting circuit for clipping, at a predetermined threshold, the optical output level extension signal outputted from the optical output control means, so as to output the clipped optical output level extension signal as the reference signal for the lamp control signal; and a video amplitude gain calculating circuit for calculating the video amplitude gain by normalizing and taking an inverse of the output signal of the waveform restricting circuit.

7. The display apparatus as set forth in claim 6, wherein the waveform restricting circuit clips the optical output level extension signal by the threshold used by the level converting circuit.

8. The display apparatus as set forth in claim 4, wherein the varied component detecting block includes:

a level converting circuit for subtracting a predetermined threshold from the optical output level extension signal outputted from the optical output control means, so as to output a positive component of a subtraction result;

a differentiating circuit for differentiating an output signal of the level converting circuit with a certain time constant;

a luminance adaptive converting circuit for multiplying a positive component of the output of the differentiating circuit by a predetermined coefficient and clipping a negative component, so as to calculate a signal for controlling a light quantity of the operating means; and a clip circuit for clipping an upper limit of the output of the luminance adaptive converting circuit, so as to prevent the lamp control signal from being outputted above the peak of the lamp.

9. The display apparatus as set forth in claim 5, wherein the reference signal/video amplitude gain calculating block includes:

a waveform restricting circuit for clipping, with a predetermined threshold, the optical output level extension signal outputted from the optical output control means, so as to output the clipped optical output level extension signal as the reference signal for the lamp control signal; and a video amplitude gain calculating circuit for calculating the video amplitude gain by normalizing and taking an inverse of a result of addition to a negative component of the output of the luminance adaptive converting circuit.

10. The display apparatus as set forth in claim 1, wherein the brightness is a parameter that is calculated from pixel information of a video and that indicates brightness of a video frame, irrespective of a signal type.

11. The display apparatus as set forth in claim 10, wherein the brightness is based on a parameter indicative of brightness, including a maximum value, mean value, or minimum value of yellow (Y) in a video frame.

12. The display apparatus as set forth in claim 10, wherein the brightness is based on a combination of RGB values, which are parameters indicative of brightness, and that the brightness of a brightest pixel in a video frame is used as the brightness of the video frame.

13. The display apparatus as set forth in claim 10, wherein the brightness is an upper predetermined percent of pixel brightness obtained from a histogram of parameters that indicate the brightness of a video frame.

14. The display apparatus as set forth in claim 10, wherein the brightness is determined not from information of a single video frame, but is determined by taking into account information of a previous video frame.

15. The display apparatus as set forth in claim 10, wherein a scene of normal brightness and a scene brighter than normal brightness be separated from each other by a threshold.

* * * * *